United States Patent [19]

Johanns

[11] 4,055,009

[45] Oct. 25, 1977

[54] ANIMAL BREEDING CHART

[76] Inventor: Rudolph W. Johanns, 104 S. Court St., Wampsville, N.Y. 13163

[21] Appl. No.: 674,982

[22] Filed: Apr. 8, 1976

[51] Int. Cl.[2] ..... G09D 3/00

[52] U.S. Cl. ..... 40/107

[58] Field of Search ..... 40/86, 107, 117; 281/7

[56] References Cited

U.S. PATENT DOCUMENTS

| | | | |
|---|---|---|---|
| 1,267,935 | 5/1918 | Townsend | 40/117 |
| 2,980,325 | 4/1961 | Pisarra | 40/117 X |
| 3,406,474 | 10/1968 | Bates | 40/107 X |

*Primary Examiner*—Louis G. Mancene
*Assistant Examiner*—Wenceslao J. Contreras
*Attorney, Agent, or Firm*—Kenneth W. Greb

[57] ABSTRACT

A breeding chart for dairy cows includes a housing, a calendar with three columns movably supported in the housing, a main indicator line marked on the housing and extends across the three columns, and a magnet representing a particular cow carried by the calendar in the first column at two day increments to the main indicator line, for indicating the initiation of a breeding cycle. The magnet is carried by the calendar in the second column at two day increments to the main indicator line for indicating checking time for breeding conception of the breeding cycle. The magnet is carried by the calendar in the third column at two day increments to the main indicator line for indicating checking time for starting a drying portion of a breeding cycle.

5 Claims, 1 Drawing Figure

ANIMAL BREEDING CHART

BACKGROUND OF THE INVENTION

This invention relates to a breeding chart for dairy cows and more particularly to an improved system for indicating vital time periods during the breeding cycle of a dairy cow.

A known breeding chart for dairy cows is taught in a U.S. Pat. No. 3,406,474 issued to W. Bates on Oct. 22, 1968. This chart has a disadvantage in that the vital time periods during the breeding cycle of dairy cows are irregularly spaced about a disc, which represents a 365 day calendar year. If this chart is not observed very carefully, vital time periods such as breeding time or checking time for conception would be missed resulting in undesirable costly delays in the breeding cycle.

SUMMARY OF THE INVENTION

A breeding chart for dairy cows has a housing, a roller means supported on the housing, and a calendar supported on the roller means for movement relative the housing, the calendar has first, second and third columns with day and month indicia along each column. The housing has a start indicator located near the bottom of the first column and a number indicator spaced 60 days from the start indicator. A main indicator line is marked on the housing in alignment with the number indicator and extends across the three columns on the calendar. A magnet representing a particular cow is carried by the calendar in the firt column at two day increments from the start indicator to the main indicator line for indicating the initiation of a breeding cycle. After breeding the particular cow, the magnet is relocated from the position near the main indicator line in the first column to the start indicator position in the second column. The magnet is then carried by the calendar in the second column at 2 day increments to the main indicator line for indicating checking time for breeding conception. When the magnet reaches the top of the second column or approximately 120 days before calving, the magnet is relocated from the second column to the start indicator position in the third column. The magnet is then carried by the calendar in the third column at 2 day increments to the main indicator line for indicating checking time for starting a drying portion of the breeding cycle.

An object of this invention is to provide a breeding chart having a single master control line (main indicator line) for conveniently and efficiently indicating the vital time periods to take action during the breeding cycle of a dairy cow.

Other objects of this invention is to provide a breeding chart which is compact in size, has a relatively low manufacturing cost, and provides a permanent record.

DESCRIPTION OF THE PREFERRED EMBODIMENT

Figure 1:
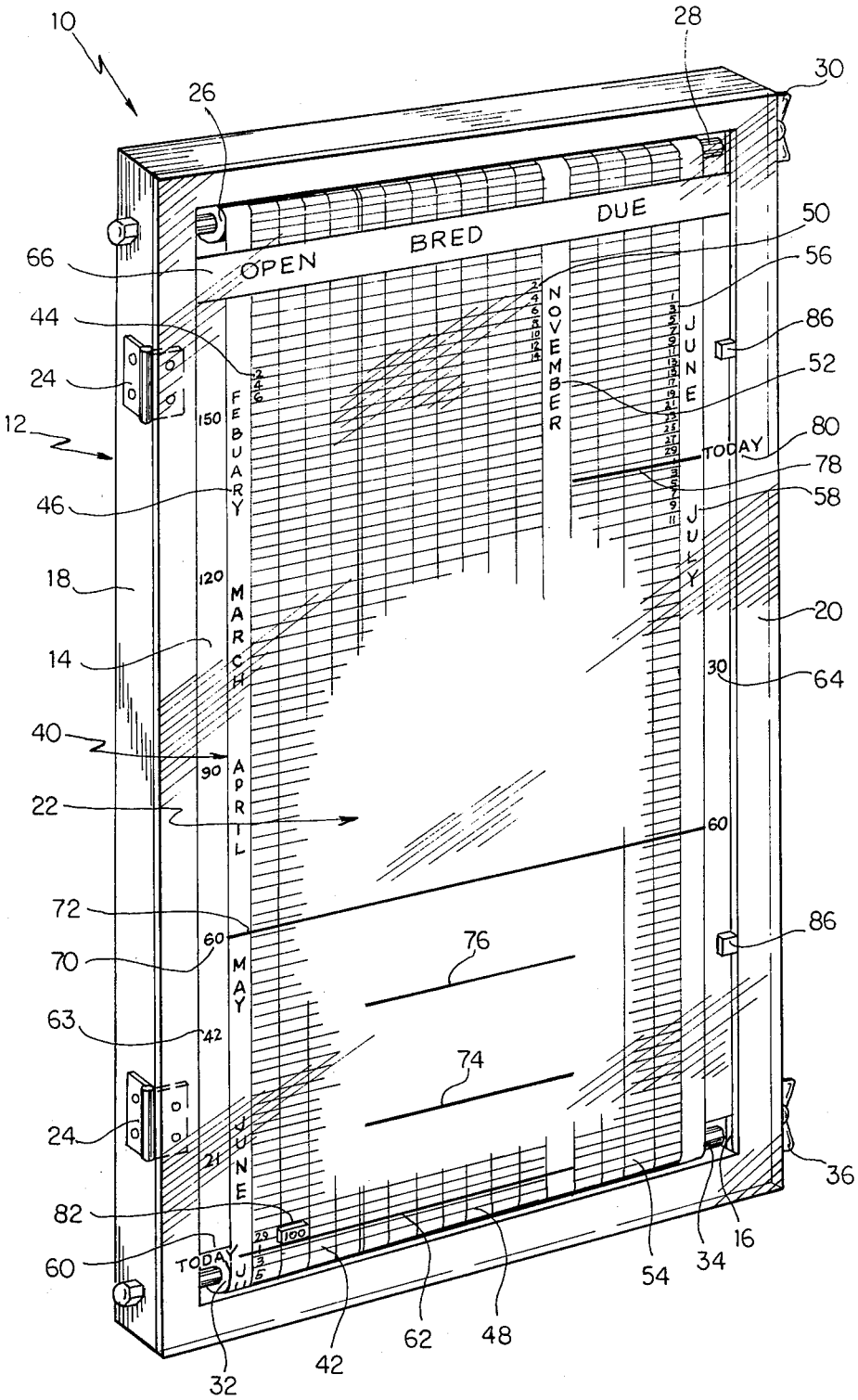
FIG. 1 is a front perspective view of the breeding chart of the present invention.

Referring to FIG. 1, the breeding chart has a housing 10 which includes a wood frame 12, a steel plate 14 seated in grooves 16 (one shown) in two side sections 18 and 20 of the wood frame 12 and a transparent cover 22 attached to the wood frame 12 by hinges 24.

A first roller 26 is rotatably supported in the wood frame 12 near the top by a shaft 28. A wing nut 30 is threaded on one end of the shaft 28 for manually rotating the first roller 26. A second roller 32 is rotatably supported in the wood frame 12 near the bottom by a shaft 34. A wing nut 36 is threaded on one end of the shaft 34 for manually rotating the second roller 32.

A calendar 40 is attached at one end to the first roller 26, extends along the length of the steel plate 14 and is attached at the other end to the second roller 32. The calendar 40 is moved relative to the housing 10 by rotating either the first roller 26 or the second roller 32. The calendar 40, alternatively, can be formed in a continuous loop and supported by the first roller 26 and the second roller 32 for movement relative to the housing 10. The calendar 40 has a first column 42 extending along its length and between the first roller 26 and the second roller 32. Day indicia 44 and month indicia 46 extend along the first column 42. The calendar 40 has a second column 48 parallel to the first column 42. The second column 48 has day indicia 50 and month indicia 52 along its length in a sequence of 282 days beyond the day and month indicia in the first column 42. The 282 day period is the average length of gestation (the period from conception to calving). The calendar 40 has a third column 54 adjacent and parallel to the second column 48. The third column 54 has day indicia 56 and month indicia 58 along its length is a sequence of 120 days beyond the day and month indicia in the second column 48.

A start indicator (TODAY) 60 is marked on the cover 22 near the second roller 32. A start line 62 is marked on the cover 22 in alignment with the start indicator 60 and extends across the first column 42 and the second column 48. Day indicia (21, 42, 60, 90, 120, and 150) 63 is marked on the steel plate 14 adjacent to and along the length of the first column 42. Day indicia (60, 30) 64 is marked on the steel plate 14 adjacent to and along the length of the third column 54.

A steel bar 66 is seated in the grooves 16 above the steel plate 14. Marked on the steel bar 66 in alignment with the first column 42 is the word "OPEN" for representing a non-pregnant portion of the breeding cycle. Marked on the steel bar 66 in alignment with the second column 48 is the word "BRED" for representing a bred portion of the breeding cycle. Marked on the steel bar 66 in alignment with the third column 54 is the word "DUE" for representing a drying portion and a calving time of the breeding cycle.

Included in the day indicia 63 is a number indicator 70 which represents 60 days after the start indicator. A main indicator line 72 is marked on the cover 22 in alignment with the number indicator 70 and extends across the first column 42, the second column 48 and the third column 54. Indicator lines 74 and 76 are marked on the cover 22 in alignment with the second column 48 and in alignment with number indicators 21 and 42 of the day indicia 63 for representing the most likely times of in-heat periods of the breeding cycle. Another indicator line 78 is marked on the cover 22 in alignment with the third column 54 and in alignment with TODAY indicator 80 for representing a calving period of the breeding cycle.

A magnet 82 is numbered (100) to represent a particular cow. The magnet 82 can be placed anywhere on the calendar 40 and it will stay in place due to being magnetically attracted by the steel plate 14. The amount of magnetic attraction is low enough to allow the calendar 40 to carry the magnet 82 as the calendar 40 moves relative to the housing 10 by the wing nut 30. Therefore, when the magnet 82 is placed on the calendar 40 in alignment with a specific date, the magnet 82 will stay with this specific date while the calendar 40 is advanced, usually at 2 day increments, toward the top of the housing 10. The magnet 82 has a first identification (red color) to indicate a specific condition of the cow when the magnet 82 is in the first, second or third column. The magnet 82 has a second identification (green color) to indicated a different condition of the cow than the first identification when the magnet 82 is in the first, second or third column. The magnet 82 can be blank or prenumbered. The magnet 82 can be placed or adjusted relative to the calendar 40 by opening the cover 22 from the wood frame 12. The cover 22 has two magnets 86 cemented thereto which are magnetically attracted to the metal plate 14 for holding the cover 22 in a closed position. The cover 22 covers substantially the entire housing 10.

The use of this breeding chart will now be explained. At calving time, the magnet 82 is placed at the start indicator 60 with the first identification (red) showing. The red identification indicates the cow has not yet been in-heat. When an in-heat period is detected, the magnet 82 is turned over to show the second identification (green). Continued advancing of the calendar 40 carries the magnet 82 to the main indicator line 72 for indicating the time for breeding the cow 100.

If in-heat periods are not detected for the cow 100, the red identification magnet 82 will continue to advance above the main indicator line 72. When the red identification magnet 82 has advance above the main indicator line 72, an abbreviated glance at the breeding chart will readily indicate that cow 100 is not initiating the breeding cycle and should be examined for some physiological disorder.

After breeding cow 100, the magnet 82 is relocated from the first column 42 to the start indicator 60 in the second column 48. The red identification of the magnet 82 is shown to indicate the cow has been bred, but has not yet been checked for conception. The calendar 40 is again advanced at two day increments and carries the magnet 82 past the 21 and 42 day indicator lines 74 and 76, respectively, which represent the most likely times for in-heat periods if the cow did not conceive at the original breeding service (at the start indicator 60 in the second column 48). If the cow 100 is rebred while in the second column 48, the magnet 82 is returned to the start indicator 60 in the second column 48. When the magnet 82 reaches the main indicator line 72, this indicates cow 100 is ready for checking for breeding conception. If the cow 100 has conceived, the magnet 82 is turned over to show the second identification (green) and the magnet 82 continues to advance to the top of the second column 48. If the cow 100 has not been checked for conception, the red identification magnet 82 will advance above the main indicator line 72 and, again, an abbreviated glance at the breeding chart will readily indicate that cow 100 is beyond the optimum time for checking conception and action should be taken.

After the magnet 82 has reached the top of the second column 48 or when the cow 100 is approximately 120 days before calving, the magnet 82 is relocated to the start indicator 60 in the third column 54. The red identification of the magnet 82 is shown to indicate the cow 100 is still milking. The calendar 40 is again advanced at 2 day increments which carries the magnet 82 to the main indicator line 72 for indicating checking time for starting a drying period of the breeding cycle. When the cow 100 has dried shortly after the magnet 82 has past the main indicator line 72, the magnet 82 is turned over to show the second identification (green) and the magnet 82 continues to advance to the indicator line 78. When the magnet 82 reaches the indicator line 78, the cow 100 is ready for calving. After calving, the magnet 82 is relocated to the start indicator 60 in the first column 42 at the same date it was removed from in the third column 54 and cow 100 is ready to repeat the breeding cycle. If the cow 100 does not dry shortly after the main indicator line 72, the red identification magnet 82 will advance above the main indicator line 72 and, again, an abbreviated glance at the breeding chart will readily indicate that cow 100 is out of the desirable breeding cycle and immediate action should be taken.

This breeding chart is capable of handling a herd of up to 100 dairy cows. The calendar can be used for a permanent record by writing the number of the cow on the calendar below the magnet in each location the magnet is placed.

It can now be understood that when any red identification magnet advances above the main indicator line in any one of the three columns, an abbreviated glance at the breeding chart will indicate which cows need immediate attention during the vital time periods of the breeding cycle. With this information, immediate action can be taken to minimize undesirable costly delays in the breeding cycle.

What is claimed is:

1. An animal breeding chart comprising:

a housing;

a roller means supported on the housing;

a calendar supported on the roller means for movement relative to the housing, the calendar having a first column extending along the housing, the calendar having a second column substantially parallel to the first column;

means dividing the first and second column into a series of days and months;

a start indicator marked on the housing adjacent the first column;

a number indicator marked on the housing adjacent the first column and spaced 60 days from the start indicator;

a main indicator line marked on the housing in alignment with the number indicator and extends across the first column and the second column; and an animal indicator detachably placed in the first column in alignment with the start indicator and with a predetermined day and month for starting a breeding cycle for a particular animal, the animal indicator advances toward and reaches the main indicator line as the calendar moves relative to the housing at predetermined day increments for indicating breeding time for the particular animal, the animal indicator when moved from the first column and placed in alignment with the start indicator in the second column advances toward and reaches the main indicator line in the second column as the calendar advances at the predetermined day increments for indicating checking time for breeding conception of the particular animal.

2. An animal breeding chart as defined in claim 1 wherein the calendar further comprises a third column substantially parallel to the second column, means dividing the third column into a series of days and months, the main indicator line extends across the third column 60 days from the start indicator, the animal indicator is relocated from the second column to the third column in alignment with the start indicator, the animal indicator advances toward and reaches the main indicator line in the third column as the calendar advances at the predetermined day increments for indicating checking time for starting a drying period of the breeding cycle.

3. An animal breeding chart as defined in claim 2 wherein the animal indicator has a first identification indicating the particular animal being in condition for milking when the animal indicator is located in the third column and below the main indicator line, and the animal indicator has a second identification indicating the particular animal has dried when the animal indicator is near the main indicator line in the third column.

4. An animal breeding chart as defined in claim 1 wherein the animal indicator has a first identification indicating the absence of an in-heat condition of the particular animal when the animal indicator is located in the first column and below the main indicator line, the animal indicator has a second identification indicating an in-heat condition of the particular animal when the animal indicator approaches the main indicator line in the first column.

5. An animal breeding chart as defined in claim 1 wherein the animal indicator has a first identification indicating the particular animal requires checking for breeding conception when the animal indicator is located in the second column and below the main indicator line, and the animal indicator has a second identification indicating the particular animal has conceived when the animal indicator approaches the main indicator line in the second column.

* * * * *